United States Patent [19]

Donnell

[11] Patent Number: 4,625,969

[45] Date of Patent: Dec. 2, 1986

[54] JIGSAW PUZZLE

[76] Inventor: John L. Donnell, 2740 Kincaid, Eugene, Oreg. 97405

[21] Appl. No.: 702,789

[22] Filed: Feb. 19, 1985

[51] Int. Cl.[4] ..... A63F 9/10
[52] U.S. Cl. ..... 273/157 R
[58] Field of Search ..... 273/157 R

[56] References Cited

U.S. PATENT DOCUMENTS 3,540,732 11/1970 Wilson ..... 273 R/157 R
4,259,804 4/1981 Samuels ..... 273/157 R X

FOREIGN PATENT DOCUMENTS 559813 7/1958 Canada ..... 273/157 R

*Primary Examiner*—Anton O. Oechsle
*Attorney, Agent, or Firm*—James D. Givnan, Jr.

[57] ABSTRACT

A jigsaw puzzle having sets of puzzle pieces with the pieces of a first set being of significantly different size than those pieces of a second set. The above sets of pieces are spaced from one another by an intermediate set of puzzle pieces of graduated size which is generally indicative of the spatial relationship of the intermediate puzzle pieces to the first and second sets. The overall configuration of the puzzle may be polygonal or curvilinear.

2 Claims, 2 Drawing Figures

JIGSAW PUZZLE

BACKGROUND OF THE INVENTION

The present invention pertains generally to that type of puzzle comprised of irregularly shaped pieces and termed a jigsaw puzzle.

Known jigsaw puzzles include two dimensional pieces contiguous with two or more other pieces of the puzzle. Such puzzles range from those having very large pieces for those less skilled in working jigsaw puzzles to puzzles having a myriad of very small pieces requiring a high degree of puzzle working skill. Further, a pictorial display comprised by the joined pieces may contribute, in different degrees, to the puzzle solution.

SUMMARY OF THE PRESENT INVENTION

The present invention is embodied within a puzzle intended for the entertainment of two or more people and having a wide range of piece sizes in a predetermined spatial relationship.

The present puzzle includes pieces of two dimensioned configuration. The wide variance of piece sizes provides a puzzle having areas suited for assembly by an adult and child or others having different degrees of puzzle working ability. For example, a zone with the larger puzzle pieces may be successfully worked by a child while a zone with smaller pieces simultaneously worked by an adult. The joint effort and completion of such a puzzle contributes importantly toward a joint sense of accomplishment.

Important objectives of the present invention include the provision of a puzzle to be worked by and entertaining to individuals having a wide variance between jigsaw puzzle solving skills; the provision of a jigsaw puzzle wherein piece size will increase in a known direction to aid the puzzle worker; the provision of a jigsaw puzzle having a set of puzzle pieces to be joined by one participant while a second participant endeavors to complete a second set of pieces of significantly different size than those of the first set; the provision of a puzzle of the jigsaw type which may be entertaining to both adult and a young child to provide entertainment to both and a sense of joint accomplishment upon their completion of the puzzle.

DETAILED DESCRIPTION OF THE PREFERRED EMBODIMENTS

Figure 1:
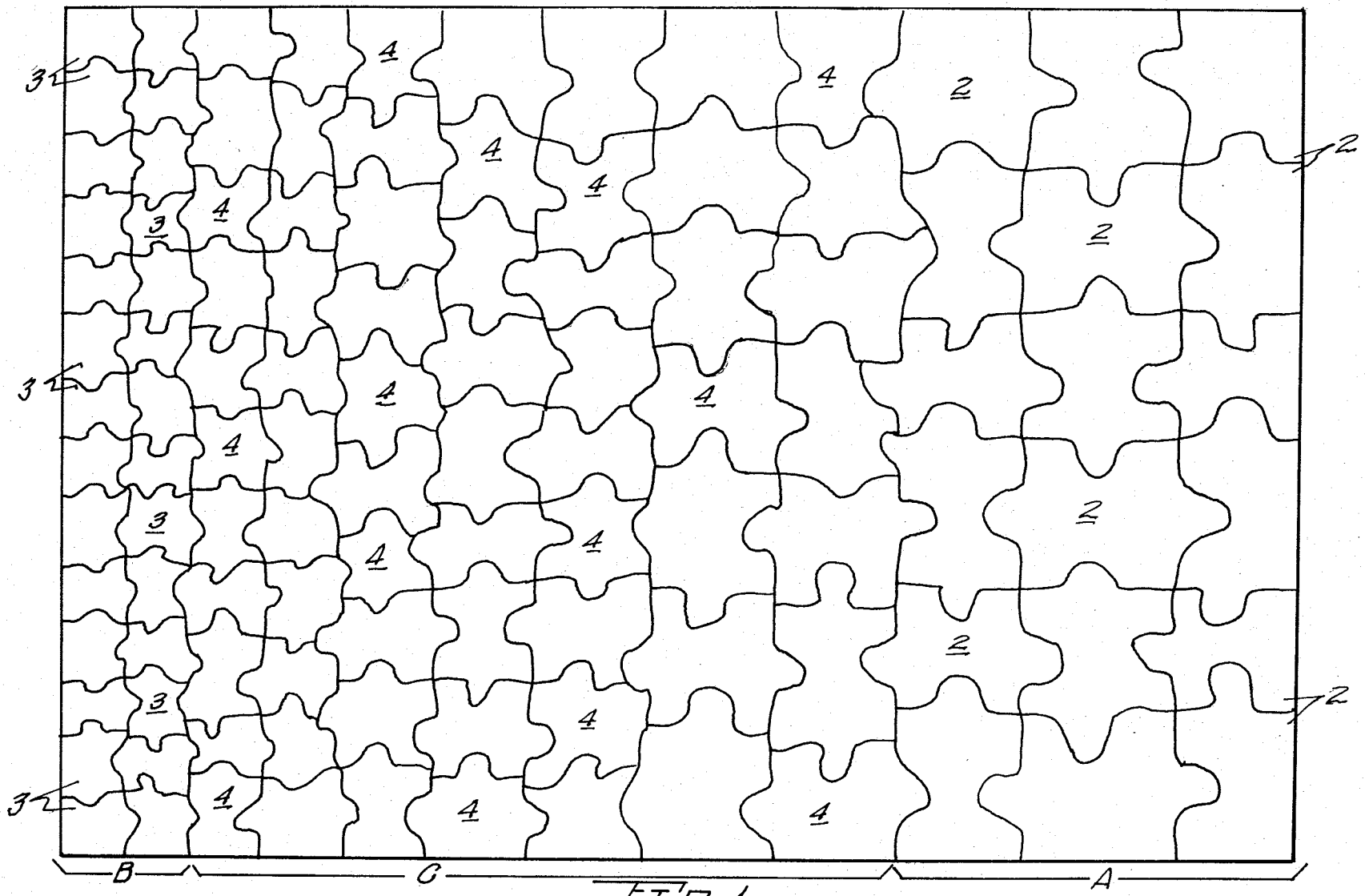
FIG. 1 is a plan view of the present puzzle shown in an elongate shape.

With continuing attention to the drawings wherein applied reference numerals indicate parts similarly hereinafter identified, the reference numeral 1 indicates generally an assembled, polygonal shaped jigsaw puzzle.

Relatively large puzzle pieces as at 2 in a zone at A comprise a first set of pieces while relatively small puzzle pieces at 3 in a zone at B comprise a second set of pieces. The pieces 2 and 3 have an obvious size variance and as shown in FIG. 1 are located in a spaced apart manner at opposite extremities of the elongate puzzle shown in FIG. 1.

The intermediate puzzle pieces at 4 in a zone at C are of graduated size or area with the larger intermediate pieces located adjacent pieces 2 while the smaller intermediate pieces are located adjacent pieces 3. Not all pieces in a zone are identified by a reference numeral.

Figure 2:
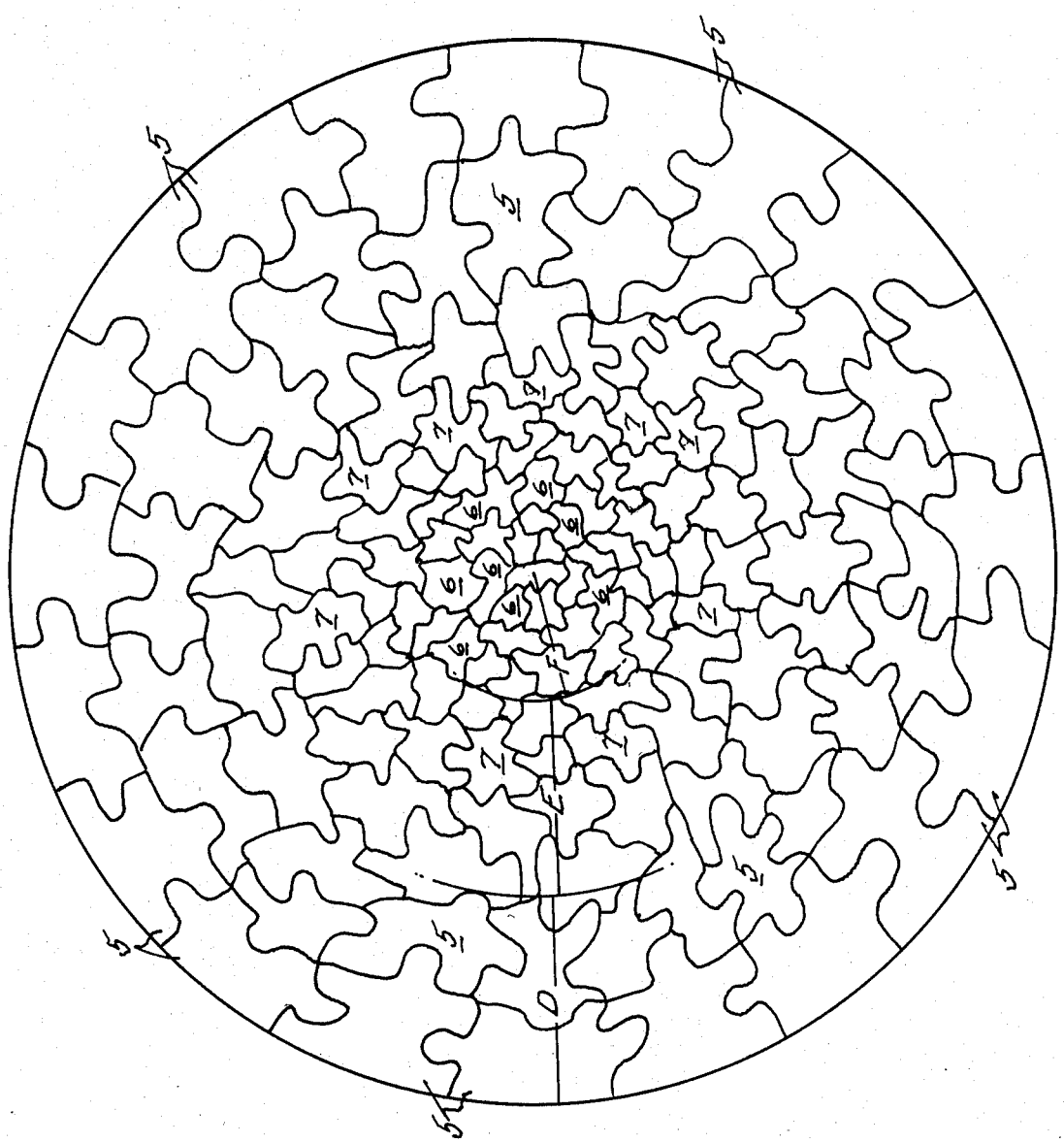
FIG. 2 is a plan view of a modified form of the puzzle.

In FIG. 2 a modified puzzle of curvilinear shape is disclosed wherein a first set of larger puzzle pieces 5 in a zone D of annular shape constitutes the outer marginal area of the puzzle. Centrally located within the modified puzzle is a second set of smaller puzzle pieces 6 in a zone E constituting a central area of the puzzle with the puzzle pieces being substantially smaller than pieces 5 comprising the first set.

An intermediate set of puzzle pieces at 7 in a zone F occupy the puzzle area between the spaced apart first and second sets of puzzle pieces and are of graduated size with size being indicative of the approximate area for correct piece placement. Accordingly the puzzle pieces of the first and second sets will be radially offset or spaced apart and vary in size with the most difficult portion of the puzzle being the central area having the smallest sized pieces.

In view of the nature of a jigsaw puzzle the zone demarcations must be approximate.

If so desired, the FIG. 2 puzzle may be in effect reversed with the smaller pieces being associated with the outer or marginal area of the puzzle with the larger pieces being centrally located. While a circular puzzle is shown in FIG. 2, it is to be understood that the overall puzzle configuration may vary beyond the shapes shown without departing from the present invention.

As is typical with previous jigsaw puzzles, a composite visual display imprinted on the puzzle pieces may facilitate puzzle working. Other visual displays such as colors may be imprinted on the pieces to aid in puzzle solution.

As earlier noted, the provision of different sizes of puzzle pieces arranged in sets renders the puzzle entertaining for two or more individuals having different degrees of puzzle working experience such as an adult and child. The first and second sets may be assembled by individual effort whereafter a certain amount of joint participation taken place to complete the puzzle.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

I claim:

1. A jigsaw puzzle comprising, a first set of relatively large contiguous puzzle pieces of substantially the same size and comprising one area of the puzzle, a second set of relatively small contiguous puzzle pieces of substantially the same size and comprising a second area of the puzzle, said second set offset from said first set, intermediate sized puzzle pieces graduated in size to provide a puzzle wherein piece size is indicative of proper piece location between the first set and the second set of pieces, and said first set of contiguous puzzle pieces occuping a marginal area of a jigsaw puzzle of rectangular shape.

2. The puzzle claimed in claim 1 wherein said first set, said second set and said intermediate set comprise a puzzle of elongate rectangular shape.

* * * * *